US011857858B2

(12) United States Patent
Briggs

(10) Patent No.: US 11,857,858 B2
(45) Date of Patent: Jan. 2, 2024

(54) BATON HAVING TUBULAR BODIES

(71) Applicant: Perspective Concepts LLC, Howard City, MI (US)

(72) Inventor: Brandon Briggs, Howard City, MI (US)

(73) Assignee: Briggs Athletics LLC, Howard City, MI (US)

( * ) Notice: Subject to any disclaimer, the term of this patent is extended or adjusted under 35 U.S.C. 154(b) by 250 days.

(21) Appl. No.: 17/216,558

(22) Filed: Mar. 29, 2021

(65) Prior Publication Data

US 2021/0402274 A1 Dec. 30, 2021

Related U.S. Application Data

(60) Provisional application No. 63/044,110, filed on Jun. 25, 2020.

(51) Int. Cl.
*A63B 69/00* (2006.01)

(52) U.S. Cl.
CPC ..... *A63B 69/0028* (2013.01)

(58) Field of Classification Search
CPC ..... A63B 69/0028; A63B 69/00; F41B 15/02; F41B 15/027
See application file for complete search history.

(56) References Cited

U.S. PATENT DOCUMENTS

| | | | | |
|---|---|---|---|---|
| 6,216,717 | B1 * | 4/2001 | Chen | E04H 15/44 135/130 |
| 6,223,441 | B1 * | 5/2001 | Parsons | A62B 3/005 30/367 |
| 7,044,858 | B1 * | 5/2006 | Otto | F41B 15/022 463/47.7 |
| 9,126,094 | B1 * | 9/2015 | Davis | G07C 1/24 |
| 2003/0139215 | A1 * | 7/2003 | Todd | F41B 15/025 463/47.6 |
| 2004/0185969 | A1 | 9/2004 | Baxter | |
| 2014/0194212 | A1 * | 7/2014 | Walter | F41B 15/027 463/47.7 |
| 2014/0357382 | A1 * | 12/2014 | Quail | F41B 15/025 463/47.7 |

FOREIGN PATENT DOCUMENTS

| | | | |
|---|---|---|---|
| CN | 200984437 | Y | 12/2007 |
| CN | 103252071 | A | 8/2013 |
| CN | 107684711 | A | 2/2018 |
| KR | 200364865 | Y1 | 10/2004 |

* cited by examiner

*Primary Examiner* — Andrew Schechter
*Assistant Examiner* — Jeremy A Delozier
(74) *Attorney, Agent, or Firm* — McGarry Bair PC

(57) ABSTRACT

The disclosure relates to a separable component such as a relay baton. The relay baton includes a first tubular body having an outer surface as well as a second tubular body at least partially surrounding the first tubular body and having an inner surface. An interface can be formed between the outer surface and the inner surface.

20 Claims, 4 Drawing Sheets

BATON HAVING TUBULAR BODIES

CROSS-REFERENCE TO RELATED APPLICATIONS

This application claims the benefit of U.S. Provisional Patent Application No. 63/044,110, filed Jun. 25, 2020, which is incorporated herein by reference in its entirety.

BACKGROUND

Track and field activities can involve competitions in which team members work as a collective to complete a race. One such example is a relay race wherein an item, typically an elongated baton, is handed from one runner to another in order to complete various segments of the race. A successful handoff involves multiple factors including running speed, timing, grip location, hand-eye coordination, and the like.

BRIEF DESCRIPTION

Aspects and advantages of the disclosure will be set forth in part in the following description, or may be obvious from the description, or may be learned through practice of the disclosure herein.

In one aspect, the disclosure relates to a relay baton, including a first tubular body having an outer surface, and a second tubular body at least partially surrounding the first tubular body and having an inner surface, with the inner surface spaced from the outer surface to define a breakaway interface.

In another aspect, the disclosure relates to a relay baton, including a first tubular body having an outer surface with a non-continuous taper, and a second tubular body at least partially surrounding the first tubular body, the second tubular body having an inner surface with a continuous taper defining a breakaway interface with the outer surface of the first tubular body.

These and other features, aspects and advantages of the disclosure will become better understood with reference to the following description and appended claims. The accompanying drawings, which are incorporated in and constitute a part of this specification, illustrate the disclosure and, together with the description, serve to explain the principles of the disclosure herein.

BRIEF DESCRIPTION OF THE DRAWINGS

A full and enabling disclosure, including the best mode thereof, directed to one of ordinary skill in the art, is set forth in the specification, which makes reference to the appended figures in which.

DETAILED DESCRIPTION

Figure 1:
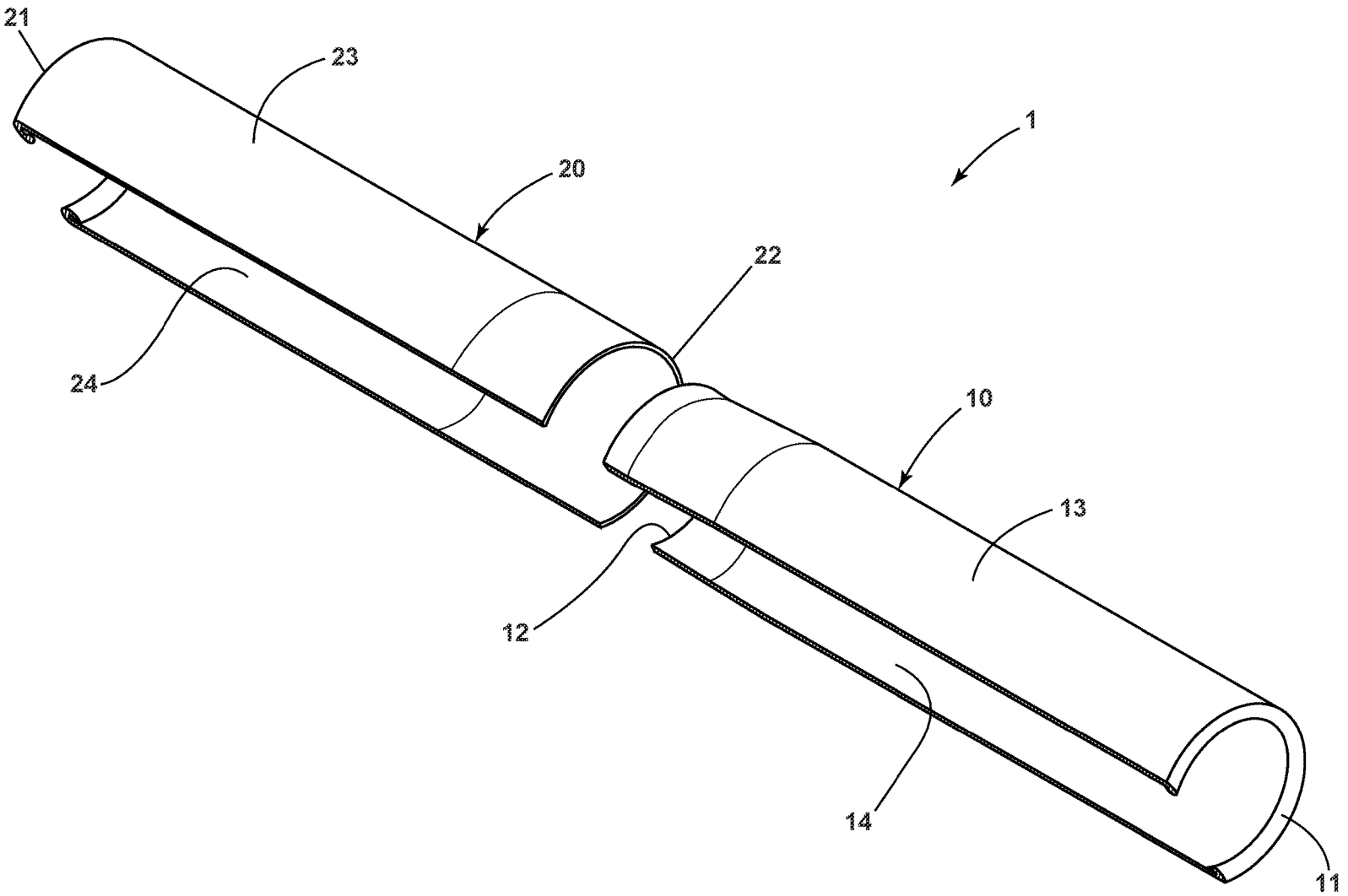
FIG. 1 is a partially-exploded perspective view of a relay baton having a first tubular body and a second tubular body in accordance with various aspects described herein.

Aspects of the present disclosure are directed to a device having a set of tubular bodies configured to be assembled as a unit and easily separable. The device will be described herein in in one exemplary context of a sports training device, and more specifically, as a training relay baton. It will be understood that aspects of the disclosure can have general applicability, including in other sports, training, or modeling environments.

The relay baton in one implementation can be utilized in a sports environment, for example as part of a relay race in which a first user passes the baton to a second user while running, jumping, or the like. A typical relay baton is a single piece baton that can be passed from one runner to another. A successful handoff of the baton without dropping or fumbling is key to minimizing the time needed to complete the race. Aspects of the disclosure provide for a training relay baton that is easily separated during handoff, for example during a training race, such that each participant in the handoff is able to analyze and improve technique regarding grip, timing, aim, or the like.

All directional references (e.g., radial, axial, upper, lower, upward, downward, left, right, lateral, front, back, top, bottom, above, below, vertical, horizontal, clockwise, counterclockwise) are only used for identification purposes to aid the reader's understanding of the disclosure, and do not create limitations, particularly as to the position, orientation, or use thereof. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to each other. In addition, as used herein, "a set" of elements can include any number of the respective elements, including only one element.

Furthermore, as used herein, a "tubular" element will refer to any element having a generally elongated geometric profile. Such "tubular" elements can have a cross-sectional profile that is round, square, triangular, rounded with one or more corners, symmetric, asymmetric, or irregular, in non-limiting examples. Such "tubular" elements can also be hollow, solid, or a combination thereof.

The exemplary drawings are for purposes of illustration only and the dimensions, positions, order and relative sizes reflected in the drawings attached hereto can vary.

FIG. 1 illustrates one exemplary separable device in the form of a training relay baton 1, with a partial portion of the baton cut away to show the inside of the baton 1. The relay baton 1 includes a set of tubular bodies. In the example shown, the relay baton 1 includes a first tubular body 10 and a second tubular body 20. Any number of tubular bodies can be included in the relay baton 1, including three or more tubular bodies. The first and second tubular bodies 10, 20 can be formed of any suitable material, including aluminum, plastic, carbon fiber, or the like, or combinations thereof.

The first tubular body 10 extends between a first distal end 11 and a first coupling end 12. The first tubular body 10 also defines a first outer surface 13 and a first inner surface 14. The second tubular body 20 extends between a second distal end 21 and a second coupling end 22 and defines a second outer surface 23 and a second inner surface 24. While the first distal end 11 and second distal end 21 are shown as having a rolled finish, this is for illustrative purposes only. The first and second distal ends 11, 21 can have any geometry or profile, including flat edges, bevels, curves, or the like.

When assembled, the second tubular body 20 can at least partially surround the first tubular body 10 such that the first tubular body 10 is at least partially received within the second tubular body 20. In one non-limiting example, the bodies 10, 20 can be coupled by a press-fit or friction-fit mechanism between the first inner surface 14 and the second outer surface 23 at the respective first and second coupling ends 12, 22. Additionally or alternatively, the tubular bodies 10, 20 can be coupled by any suitable mechanical fastener or chemical fastener, including pins, bolts, screws, latch and catch mechanisms, adhesives, or the like, in non-limiting examples.

Figure 2:
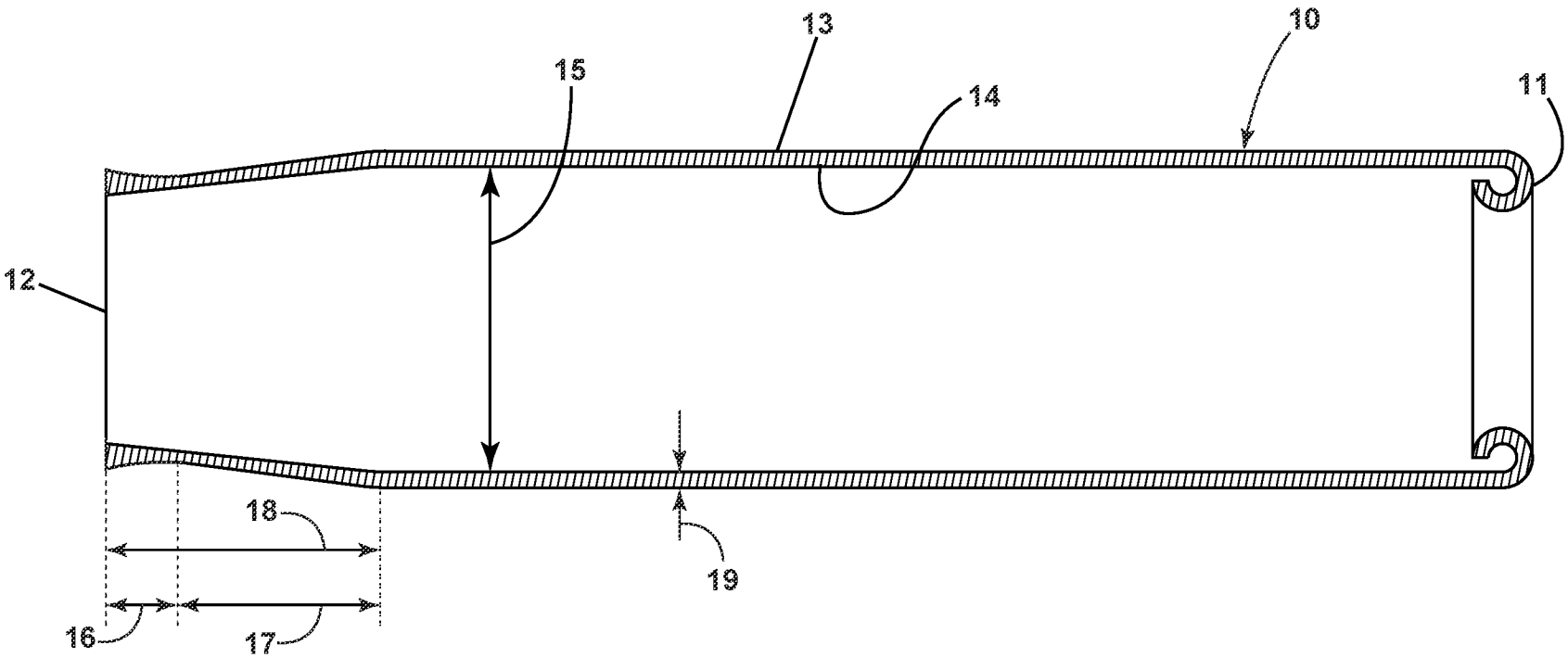
FIG. 2 is a side cross-sectional view of the first tubular body of FIG. 1.

Turning to FIG. 2, a side cross-sectional view of the first tubular body 10 is shown. A first internal width 15 can be defined within the first tubular body 10. The first internal width 15 can be variable. In one example, the first internal width 15 can be constant for a portion of the length of the tubular body 10 and transition to a decrease in a direction toward the first coupling end 12. In other examples, the first internal width 15 can be constant or increasing within the first tubular body 10.

The first outer surface 13 of the first tubular body 10 can also include at least one tapered region. In the example shown, the first outer surface 13 includes a first tapered region 16 and a second tapered region 17. The first tapered region 16 can extend fully to the first coupling end 12 in one example. The first tapered region 16 can also abut the second tapered region 17, though this need not be the case. Optionally, the first inner surface 14 can have a tapered or angled geometry. The first and second tapered regions 16, 17 can collectively form an overall tapered region 18 along the first outer surface 13. It is contemplated that the first and second tapered regions 16, 17 can have differing slopes. In this manner the first outer surface 13 can include a non-continuous taper.

A first wall thickness 19 can be defined between the first outer surface 13 and first inner surface 14. In the illustrated example, the first wall thickness 19 is variable along the first coupling end 12. It is contemplated that the first tapered region 16 or the second tapered region 17 can be at least partially formed by a varying wall thickness 19. Additionally or alternatively, the first tapered region 16 or the second tapered region 17 can be at least partially formed by a contour or angle of the first inner surface 14, or a constant wall thickness 19, or combinations thereof.

The first tubular body 10 can have any suitable dimension, sizing, or relative proportion. In non-limiting examples, the first wall thickness 19 can be between 1 mm and 3 mm, a length of the first coupling end 12 can be between 10-30% an overall length of the first tubular body 10, and the first internal width 15 can be between 20 mm and 40 mm.

Figure 3:
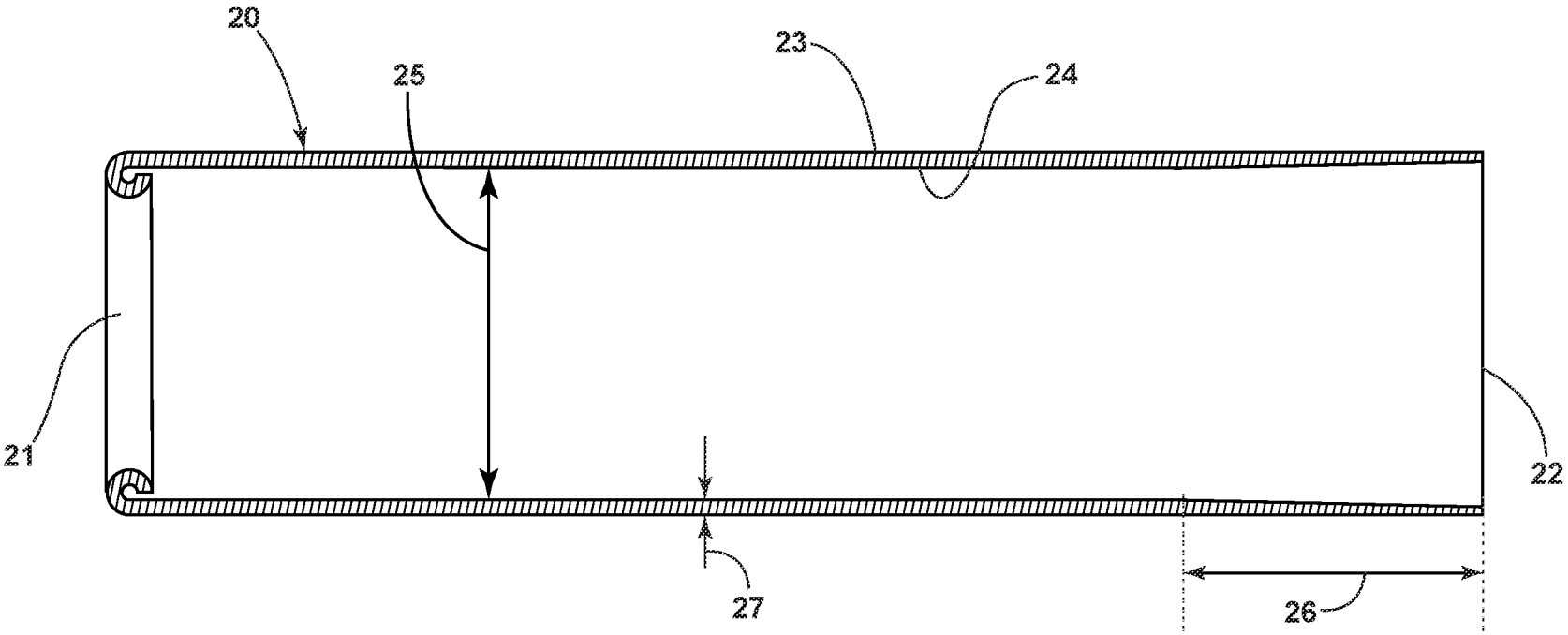
FIG. 3 is a side cross-sectional view of the second tubular body of FIG. 1.

FIG. 3 illustrates a side cross-sectional view of the second tubular body 20. A second internal width 25 can be defined within the second tubular body 20. The second internal width 25 can be variable. In one example, the second internal width 25 can be constant for a portion of the length of the tubular body 20 and transition to a decrease in a direction toward the second coupling end 22. In other examples, the second internal width 25 can be constant or increasing within the second tubular body 20.

The second inner surface 24 of the second tubular body 20 can also include at least one tapered region. In the example shown, a third tapered region 26 can be defined along the second inner surface 24. The third tapered region 26 can be located at the second coupling end 22 as shown.

A second wall thickness 27 can be defined between the second outer surface 23 and second inner surface 24. In the illustrated example, the second wall thickness 27 decreases in a direction toward the second coupling end 22. In this manner, the third tapered region 26 can be at least partially formed by a decreasing wall thickness 27. Additionally or alternatively, the third tapered region 26 can be at least partially formed by a contour or angle of the second inner surface 24, or a constant wall thickness 27, or a variable wall thickness 27, or combinations thereof.

The second tubular body 10 can have any suitable dimension, sizing, or relative proportion. In non-limiting examples, the second wall thickness 27 can be between 1 mm and 3 mm, or a length of the second coupling end 22 can be between 10-30% an overall length of the second tubular body 20, or the second internal width 25 can be between 20 mm and 40 mm.

Figure 4:
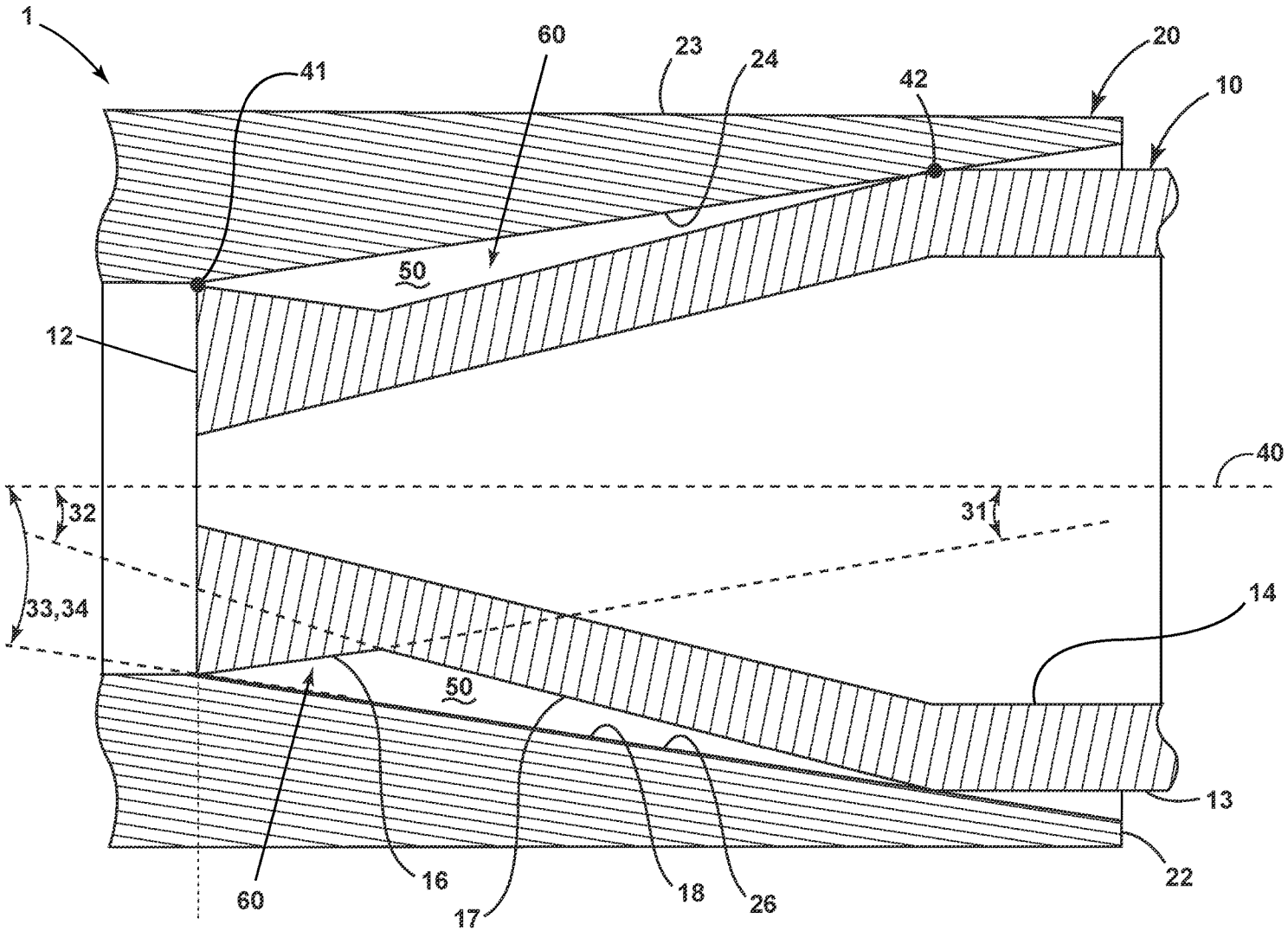
FIG. 4 is a side cross-sectional view of the assembled relay baton with the first tubular body and the second tubular body.

Turning to FIG. 4, the assembled relay baton 1 is illustrated in cross-section at the first and second coupling ends 12, 22. The sizes or thicknesses of the walls of the first and second tubular bodies 10, 20 are exaggerated for visual clarity.

When assembled, the first tubular body 10 can be coaxial with the second tubular body 20. The third tapered region 26 of the second tubular body 20 can radially overlie at least one tapered region of the first tubular body 10. In the example shown, the third tapered region 26 radially overlies both the first tapered region 16 and the second tapered region 17 though this need not be the case.

The first tapered region 16 can define a first angle 31 with respect to a longitudinal axis 40 extending through the relay baton 1. The second tapered region 17 can define a second angle 32 with respect to the axis 40. In the example shown, the first angle 31 differs from the second angle 32. More specifically, the first angle 31 can be positive and the second angle 32 can be negative with respect to the axis 40. The second angle 32 can also be greater than the first angle 31. In addition, the overall tapered region 18 can define an overall angle 34 with respect to the axis 40. The overall angle 34 can result from the combination of the first angle 31 and the second angle 32. In addition, the third tapered region 26 can define a third angle 33 with respect to the longitudinal axis 40.

The first outer surface 13 of the first tubular body 10 can abut the second inner surface 24 of the second tubular body 20 when assembled. The third tapered region 26 can align with the overall tapered region 18. Put another way, the third angle 33 formed by the second tubular body 20 can be equal to the overall angle 34 formed by the first tubular body 10.

In addition, the first outer surface 13 can form discrete points of contact with the second inner surface 24. A gap 50 can be formed between the first outer surface 13 and the second inner surface 24. In the example shown illustrating one possible implementation, the first tapered region 16 contacts or abuts the second inner surface 24 at a first point of contact 41, and the second tapered region 17 contacts or abuts the second inner surface 24 at a second point of contact 42. The gap 50 can be formed by the relative positioning of the first, second, and third tapered regions 16, 17, 26. More specifically, the gap 50 can be formed by the first tapered region 16 being directed away from the first inner surface 14 and the second tapered region 17 being directed toward the first inner surface 14. The gap 50 can extend at least between the first and second points of contact 41, 42.

A breakaway interface 60 for the relay baton 1 can be at least partially defined by the first and second points of contact 41, 42 and gap 50. For example, friction at the first and second points of contact 41, 42 between the first and second coupling ends 12, 22 can hold the ends 12, 22 together in assembly while being spatially limited to the first point of contact 41 and second point of contact 42. A perturbation, rotation, or relative movement of the first tubular body 10 compared to the second tubular body 20 can cause the first and second tubular bodies 10, 20 to separate. The breakaway interface 60 can provide for ease of separation of the bodies 10, 20 while still allowing sufficient coupling to use the assembled relay baton 1 as a singular unit. In this manner, the non-constant taper of the first tubular body 10 abutting or radially overlying a constant taper of the second tubular body 10 can form the breakaway interface 60. In addition, the gap 50 extending at least between the first and second points of contact 41, 42 can at least partially define the breakaway interface 60.

Additionally or alternatively, the breakaway interface 60 can include multiple gaps between the first tubular body 10 and the second tubular body 20. In such a case, the first outer surface 13 can form multiple, discrete points of contact with the second inner surface 24 thereby forming multiple gaps therebetween. Any number of gaps can be provided.

In one non-limiting example of operation, a first user can hold or grasp the relay baton 1 near one end of the baton 1, such as the first tubular body 10. The first user can perform a practice or training relay race in which the baton 1 is held by the first user while running toward a stationary second user. The first user can hold out the baton 1 while grasping the first tubular body 10. During a handoff operation, the second user can grasp the second tubular body 20 and begin running while the first user stops. The breakaway interface 60 between the first and second tubular bodies 10, 20 can provide for ease in separation of the tubular bodies 10, 20 during the handoff operation. After the handoff is completed, the first and second user can analyze elements of the training race such as grip location, speed, coordination or the like based on separation of the relay baton 1 into its multiple elements.

Additionally or alternatively, the first outer surface of the first tubular body can have a curved, ridged, or sinusoidal geometric profile forming a breakaway interface between the first and second tubular bodies having multiple gaps.

Additionally or alternatively, either or both of the first tubular body and the second tubular body can be solid. In one example, the second coupling end can have a solid form and provided with a slot configured to receive the first coupling end. In another example, the second coupling end can be hollow with a remainder of the second tubular body being solid. In still another example, the first tubular body or the second tubular body can have both hollow and solid interior portions. Such examples can provide for customized weight or balancing of the first and second tubular bodies.

Additionally or alternatively, three or more tubular bodies as described herein can be coupled together to form a separable component. In such a case, aspects of the disclosure can provide for one or multiple breakaway interfaces between any or all of the tubular bodies forming the assembled component. In one example, two tubular bodies can be rigidly secured together and coupled to a third tubular body by way of a breakaway interface. In another example, multiple tubular bodies can each be connected to one another by way of a breakaway interface, wherein an applied force or other perturbation at some location along the assembled component can be made visible or otherwise indicated by way of separation between adjacent tubular bodies at that location.

Aspects of the disclosure provide for a releasable coupling between assembled bodies by way of reduced friction between such assembled bodies, including for use in a relay baton for training or analysis purposes. In the context of a relay baton, the reduction in surface contact provides for a breakaway interface and allows for improved, specific focus on handoff technique during training compared to traditional relay batons. Such a separable component can also be utilized in a variety of environments, including other physical modeling, training, or simulation environments where ease in separation and assembly improves process efficiencies.

Many other possible aspects and configurations in addition to that shown in the above figures are contemplated by the present disclosure.

To the extent not already described, the different features and structures of the various aspects can be used in combination with each other as desired. That one feature is not illustrated in all of the aspects is not meant to be construed that it is not included, but is done for brevity of description. Thus, the various features of the different aspects can be mixed and matched as desired to form new aspects of the disclosure, whether or not the new aspects are expressly described. All combinations or permutations of features described herein are covered by this disclosure.

This written description uses examples to disclose aspects of the disclosure, including the best mode, and also to enable any person skilled in the art to practice the aspects of the disclosure, including making and using any devices or systems and performing any incorporated methods. The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A relay baton, comprising:

a first tubular body having an outer surface; and a second tubular body at least partially surrounding the first tubular body and having an inner surface, with the inner surface spaced from the outer surface to define a breakaway interface therebetween.

2. The relay baton of claim 1, wherein the outer surface of the first tubular body further comprises a first tapered region defining a first angle and a second tapered region defining a second angle with respect to a longitudinal axis through the relay baton.

3. The relay baton of claim 2, wherein the second angle is greater than the first angle.

4. The relay baton of claim 2, wherein the first angle is positive and the second angle is negative.

5. The relay baton of claim 2, wherein the first tapered region abuts the second tapered region, with the first and second tapered regions at least partially forming an overall tapered region defining an overall angle with respect to the longitudinal axis.

6. The relay baton of claim 5, wherein the inner surface of the second tubular body further comprises a third tapered region defining a third angle with respect to the longitudinal axis.

7. The relay baton of claim 6, wherein the third angle of the third tapered region is equal to the overall angle of the overall tapered region.

8. The relay baton of claim 2, wherein the first tapered region contacts the second tapered region at two points of contact along the second tapered region to form a gap between the inner surface of the second tubular body and the outer surface of the first tubular body, thereby defining the breakaway interface.

9. The relay baton of claim 2, wherein the first tapered region extends to a distal end of the first tubular body.

10. The relay baton of claim 1, wherein the first tubular body is coaxial with the second tubular body when coupled.

11. The relay baton of claim 10, wherein the outer surface of the first tubular body further comprises at least one tapered region at least partially forming the breakaway interface.

12. The relay baton of claim 11, wherein the inner surface of the second tubular body comprises a third tapered region that radially overlies the at least one tapered region of the first tubular body.

13. The relay baton of claim 11, wherein the at least one tapered region forms an overall tapered region along the first tubular body.

14. A relay baton, comprising:

a first tubular body having an outer surface with a non-continuous taper; and a second tubular body at least partially surrounding the first tubular body, the second tubular body having an inner surface with a continuous taper defining a breakaway interface with the outer surface of the first tubular body.

15. The relay baton of claim 14, wherein the non-continuous taper further comprises at least a first tapered region defining a first angle and a second tapered region defining a second angle with respect to a longitudinal axis through the relay baton.

16. The relay baton of claim 15, wherein the first angle is positive and the second angle is negative.

17. The relay baton of claim 15, wherein the first tapered region abuts the second tapered region, with the first and second tapered regions at least partially forming an overall tapered region defining an overall angle with respect to the longitudinal axis.

18. The relay baton of claim 17, wherein the continuous taper of the second tubular body comprises a third tapered region defining a third angle with respect to the longitudinal axis.

19. The relay baton of claim 18, wherein the third angle of the third tapered region is equal to the overall angle of the overall tapered region.

20. The relay baton of claim 14, wherein the continuous taper of the second tubular body radially overlies the non-continuous taper of the first tubular body.

* * * * *